US008211814B2

(12) United States Patent
Pepka

(10) Patent No.: US 8,211,814 B2
(45) Date of Patent: Jul. 3, 2012

(54) PROTECTIVE ARMOR PANELS

(75) Inventor: Charles F. Pepka, Bellevue, WA (US)

(73) Assignee: Renton Coil Spring Company, Renton, WA (US)

( * ) Notice: Subject to any disclaimer, the term of this patent is extended or adjusted under 35 U.S.C. 154(b) by 1057 days.

(21) Appl. No.: 12/028,660

(22) Filed: Feb. 8, 2008

(65) Prior Publication Data

US 2012/0055324 A1 Mar. 8, 2012

(51) Int. Cl.

| | |
|---|---|
| ***B32B 5/02*** | (2006.01) |
| ***B32B 27/12*** | (2006.01) |
| ***B32B 5/12*** | (2006.01) |
| ***B32B 23/02*** | (2006.01) |
| ***D03D 15/00*** | (2006.01) |

(52) U.S. Cl. ..... 442/134; 442/135; 442/185; 442/186; 442/228; 442/229; 442/236; 442/286; 428/105; 428/111; 428/192; 428/193

(58) Field of Classification Search ..... 442/185–186, 442/228–229, 236, 286, 134–135
See application file for complete search history.

(56) References Cited

U.S. PATENT DOCUMENTS

| | | | | |
|---|---|---|---|---|
| 2,401,281 | A | 5/1946 | Webb | |
| 3,349,836 | A | 10/1967 | Rossi | |
| 3,523,057 | A | 8/1970 | Buck | |
| 4,316,286 | A | 2/1982 | Klein | |
| 4,567,100 | A | 1/1986 | Pickett et al. | |
| 4,760,611 | A | 8/1988 | Huet et al. | |
| 4,969,386 | A | 11/1990 | Sandstrom et al. | |
| 5,045,371 | A | 9/1991 | Calkins | |
| 5,200,256 | A | 4/1993 | Dunbar | |
| 5,472,769 | A | 12/1995 | Goerz, Jr. et al. | |
| 5,622,580 | A | 4/1997 | Mannheim | |
| 6,605,334 | B2 | 8/2003 | Bettencourt | |
| 6,863,950 | B1 * | 3/2005 | Cunningham | 428/136 |
| 2001/0053645 | A1 | 12/2001 | Henderson | |
| 2004/0229533 | A1 * | 11/2004 | Braekevelt et al. | 442/6 |

FOREIGN PATENT DOCUMENTS

| | | |
|---|---|---|
| WO | 9321492 | 10/1993 |
| WO | 2005098343 | 10/2005 |

OTHER PUBLICATIONS

Wadley, Haydn N.G., Multifunctional Periodic Cellular Metals, Journal, Dec. 2, 2005, pp. 31-68, vol. 364, Philosophical Transactions of the Royal Society, United States.

Dharmaseena, Kumar P., Wadley, Haydn N.G., Xue, Zhenyu, Hutchinson, John W., Mechanical Response of Metallic Honeycomb Sandwich Panel Structure to High-Intensity Dynamic Loading, Journal, Jul. 10, 2007, pp. 1063-1074, vol. 35, International Journal of Impact Engineering, United States.

* cited by examiner

*Primary Examiner* — Lynda Salvatore
(74) *Attorney, Agent, or Firm* — Lowe Graham Jones PLLC

(57) ABSTRACT

Protective armor panels comprising a polymer layer having upper and lower faces generally forming a sheet and a plurality of metal strips each having an upper edge, a lower edge and side faces, said side faces being oriented generally traverse to the upper face of said polymer layer and positioned at least partially within the polymer layer, are disclosed.

27 Claims, 3 Drawing Sheets

PROTECTIVE ARMOR PANELS

FIELD OF THE INVENTION

This invention relates generally to protective armor panels and more specifically to protective armor panels to absorb projectiles and projectile energy.

BACKGROUND OF THE INVENTION

Protective armor such as body armor has been used for many years to provide protection from various objects which can cause bodily harm, including projectiles such as bullets, pointed objects such as knives and swords, blasts and shrapnel generated by explosive devices and the like. In the past, protective armor was rigid and heavy while modem armor, such as that fabricated from aramid fibers, for example KEVLAR, is more flexible and lightweight. However, there is often a tradeoff in that armor that is more flexible and lightweight often provides less protection than armor that is rigid and heavy.

Therefore, there is a continuing need for protective armor that is lightweight and versatile but that also provides a high degree of protection.

SUMMARY OF THE INVENTION

Protective armor panels comprising a polymer layer having upper and lower faces generally forming a sheet and a plurality of metal strips each having an upper edge, a lower edge and side faces, said side faces being oriented generally traverse to the upper face of said polymer layer and positioned at least partially within the polymer layer, are disclosed.

In one embodiment, a first set of the plurality of metal strips are arranged on edge and parallel to one another with their side faces normal to the upper face of the protective armor panel and a second set of the metal strips are arranged on edge and parallel to one another and positioned interlocked with and transverse to the first set of metal strips with their side faces normal to the upper face of the protective armor. In an alternate embodiment, the protective armor panels contain one or more additional metal grids.

The metal grid of the protective armor panels can be made from various metals, including stainless steel, while the polymer layer can be made from various polymers, including thermoplastic polymers such as polycarbonate.

Functionally, the metal grid of the protective armor panels fragments the incoming bullet or other projectile to be stopped while the polymer layer absorbs and disburses the energy of the resulting fragments so that the fragments do not escape from but rather remain within the polymer layer. Thus, the invention provides protective armor panels with a number of notable advantages, including a high degree of protection and lighter weight than conventional armor panels constructed using metal sheets.

The protective armor panels of the present invention can be used in the construction of various items in which conventional armor panels are used, including vehicles such as cars and trucks, military equipment such as tanks, armored personnel carriers and the like, general purpose vehicles such as jeeps, body armor and structures such as storage sheds and other buildings.

BRIEF DESCRIPTION OF THE DRAWINGS

Preferred and alternative embodiments of the present invention are described in detail below with reference to the following drawings. These depict particular embodiments of the invention and are not intended to limit the scope of the invention as set forth in the claims. All of the drawings are schematics rather than precise representations and are not drawn to scale.

FIG. 1 is a top and partially sectional view of a protective armor panel while

DETAILED DESCRIPTION OF THE PREFERRED EMBODIMENTS

Figure 1A:
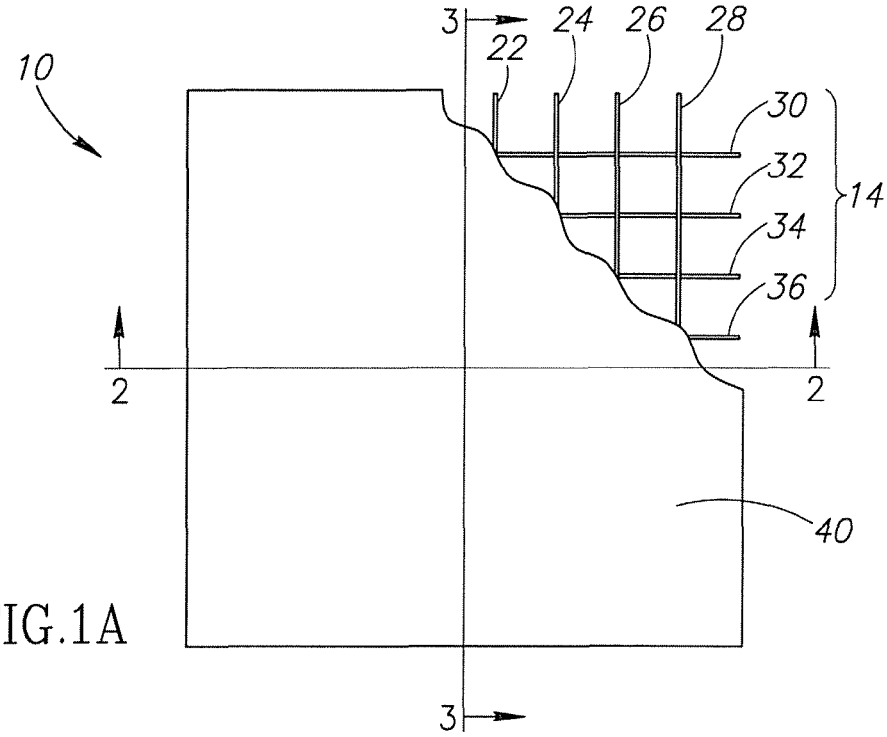
Figure 1B:
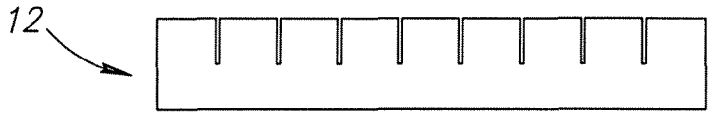
FIG. 1B is a side view of an individual metal strip used in protective armor panel, in accordance with the present invention.

Referring now to FIG. 1A, an embodiment of a protective armor panel 10 is shown that has a metal grid 14 comprising a plurality of metal strips and a polymer layer 40, which encloses the metal grid 14. In the metal grid 14, a first set of the metal strips (22, 24, 26 and 28 in the illustrated embodiment) are arranged on edge and parallel to one another with their side faces normal to the upper face of the protective armor panel 10. A second set of the metal strips (30, 32, 34 and 36 in the illustrated embodiment) are also arranged on edge, parallel to one another and positioned interlocked with and transverse to the first set of the metal strips (22, 24, 26 and 28 in the illustrated embodiment) with their side faces normal to the upper face of the protective armor 10 in order to form the metal grid 14. Alternatively, the first set of metal strips may be oriented at various transverse angles relative to the second set of metal strips. Furthermore, in some embodiments, the strips within a set of metal strips may not all be parallel to one another. FIG. 1B is a side view of an individual user protection metal strip 12 in the metal grid 14 of the armor panel 10. The polymer layer 40 is used to enclose the metal grid 14. In certain embodiments, the polymer layer 40 surrounds the metal grid 14 on all six sides.

Functionally, the metal grid 14 of the protective armor panels 10 fragments the incoming bullet or other projectile to be stopped while the polymer layer 40 absorbs and disburses the energy of the resulting fragments so that the fragments do not escape from but rather remain within the polymer layer. Thus, the protective armor panels 10 of the present invention provide a high degree of protection. Additionally, since the protective armor panels 10 of the present invention are constructed using metal strips embedded in a polymer as opposed to thick metal sheets, they are lighter in weight than conventional armor panels constructed using metal sheets.

Various metals can be used to construct the metal grid 14 used in the protective armor panels 10 of the present invention. Suitable metals include, for example, aluminum alloys, titanium and stainless steel, with stainless steel being preferred. In general, the metal used should have high tensile strength and hardness and is most commonly a "ballistic grade" metal. The individual metal strips used in the metal grid 14 can range from about ¼ inch to about ¼ inch in width and from about 0.035 inch to about 0.090 inch in thickness, while the spacing between parallel metal strips in the first set of metal strips (22, 24, 26 and 28 in the illustrated embodiment) and the second set of metal strips (30, 32, 34 and 36 in the illustrated embodiment) can range from about ⅛ inch to about ½ inch. The width, thickness and spacing of the individual metal strips as well as the length and number of the individual metal strips to be used in the protective armor panel 10 is determined by the size and shape of the protective armor panel 10 to be constructed, the caliber of the bullet or other projectile to be stopped and space and weight constraints. In general, as the caliber of the bullet or other projectile to be stopped increases, the thickness of the protective armor panel 10 increases, as does the thickness of the metal strips used in the metal grid 14. The thickness of the protective armor panel 10 can range from about 0.25 inch to about 1.5 inches. Preferably, the thickness of the protective armor panel 10 ranges from about 0.25 inch to about 0.75 inch.

Various polymers can be used in the polymer layer 40 of the protective armor panels 10 of the present invention. Suitable polymers include, for example, thermoplastic polymers such as polycarbonate (e.g., Lexan®). A preferred polymer is polycarbonate. The polymer used can be opaque, translucent or transparent, depending on the intended application. In general, the polymer used is most commonly a "ballistic grade" material. The length, width, and thickness of the polymer layer 40 is determined by the size and shape of the protective armor panel 10 to be constructed, the caliber of the bullet or other projectile to be stopped and space and weight constraints. In general, as the caliber of the bullet or other projectile to be stopped increases, the thickness of the polymer layer 40 increases.

It should be understood that more than one metal grid 14 can be used in the protective armor panels 10 of the present invention. Preferably, two metal grids are used together. The number of metal grids 14 to be used is determined by the caliber of the bullet or other projectile to be stopped and space and weight constraints. In general, as the caliber of the bullet or other projectile to be stopped decreases, the number of metal grids 14 increases to decrease the size of the resulting apparatures between the stacked grids. Alternatively, when a single metal grid 14 is used (or only a few metal grids are used), this can be accomplished by decreasing the spacing between the metal strips in the metal grid 14. When multiple metal grids 14 are used, they are typically offset from one another to decrease open spaces in the protective armor panel 10 and thereby increase its protective ability. It should be understood that the ability to see through the protective armor panel 10 decreases as the number of metal grids 14 increases. Thus, while visibility through the protective armor panel 10 may be good when a single metal grid 14 is used, visibility through the protective armor panel 10 may be limited when two or more metal grids 14 are used. Additionally, as the thickness of the polymer layer 40 increases, visibility through the protective armor panel 10 also decreases. If desired, multiple protective armor panels 10 can be used for more energy absorption and to provide a greater degree of protection.

Various methods can be used to construct the protective armor panels 10 of the present invention. In one embodiment, the metal grid 14 is first assembled after which the polymer layer 40 is applied to the metal grid 14 using well-know injection molding techniques. In an alternate embodiment, the polymer layer 40 is prepared using well-know injection molding techniques and then machined to create grooves (see discussion of FIG. 5 below) for insertion of the metal grid 14. The assembled metal grid 14 can then be placed into and secured within the groove of the polymer layer 40.

Figure 2:
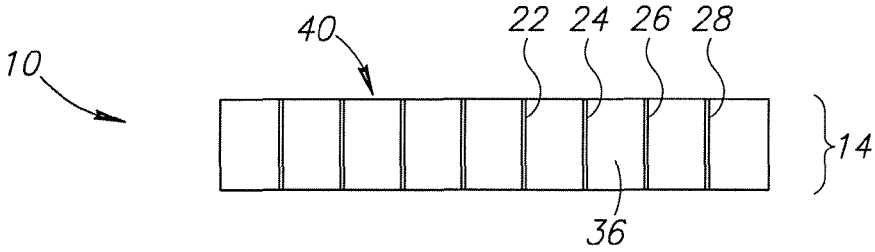
FIG. 2 is a cross-sectional elevational view of the protective armor panel shown in FIG. 1, in accordance with the present invention.

Referring now to FIG. 2, the embodiment of the protective armor panel 10 depicted in FIG. 1 is shown in a cross-sectional, elevational view in order to show the arrangement of the plurality of metal strips in the protective armor panel 10. As set forth above, the protective armor panel 10 includes the metal grid 14 comprising the plurality of metal strips and the polymer layer 40. The first set of the metal strips (22, 24, 26 and 28 in the illustrated embodiment) are arranged on edge and parallel to one another with their side faces normal to the upper face of the protective armor panel 10 while the second set of the metal strips (30, 32, 34 and 36 in FIG. 1) are also arranged on edge and parallel to one another and positioned interlocked with and transverse to the first set of the metal strips (22, 24, 26 and 28 in the illustrated embodiment) with their side faces normal to the upper face of the protective armor 10 in order to form the metal grid 14. In this cross-sectional view, the cut sections of all of the metal strips in the first set of the metal strips (22, 24, 26 and 28 in the illustrated embodiment) but only one of the side faces of the metal strip (36 in the illustrated embodiment) from the second set of the metal strips (30, 32, 34 and 36 in FIG. 1) can be seen.

Figure 3:
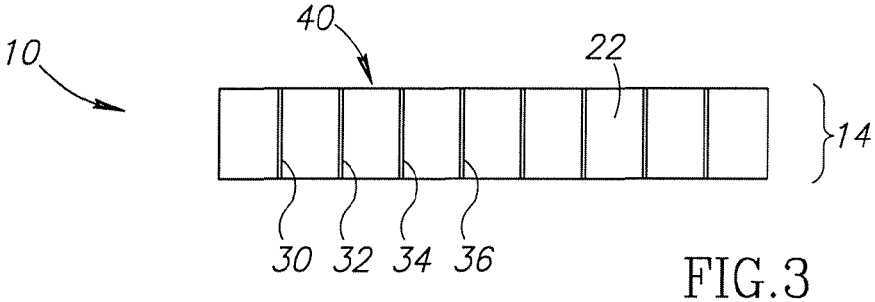
FIG. 3 is a second cross-sectional elevational view of the protective armor panel shown in FIG. 1, in accordance with the present invention.

Referring now to FIG. 3, the embodiment of the protective armor panel 10 depicted in FIG. 1 is shown in a side, elevational, cross-sectional view in order provide a different view of the arrangement of the plurality of metal strips in the protective armor panel 10. As set forth above, the protective armor panel 10 includes the metal grid 14 comprising the plurality of metal strips and the polymer layer 40. The second set of metal strips (30, 32, 34 and 36 in the illustrated embodiment) are arranged on edge and parallel to one another with their side faces parallel to the sides of the protective armor panel 10 while the first set of the metal strips (22, 24, 26 and 28 in FIG. 1) are also arranged on edge and parallel to one another and positioned interlocked with and transverse to the second set of the metal strips (30, 32, 34 and 36 in the illustrated embodiment) with their side faces normal to the upper face of the protective armor 10 in order to form the metal grid 14. In this cross-sectional view, the cut sections of all of the metal strips in the second set of the metal strips (30, 32, 34 and 36 in the illustrated embodiment) but only one of the side faces of the metal strip (22 in the illustrated embodiment) from the second set of metal strips (22, 24, 26 and 28 in FIG. 1) can be seen.

Figure 4:
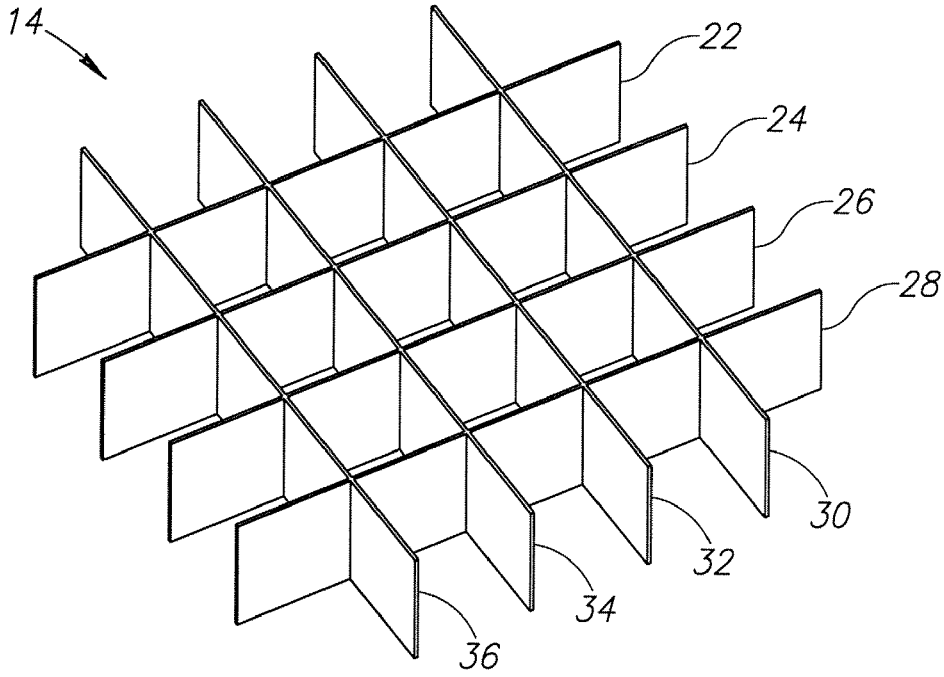
FIG. 4 is an isometric view of the metal grid of the protective armor panel shown in FIG. 1, in accordance with the present invention.

Referring now to FIG. 4, the metal grid 14 of the embodiment of the protective armor panel 10 depicted in FIG. 1 is shown in an isometric view in order to show the arrangement of the plurality of metal strips in the metal grid 14. The metal strips of the metal grid 14 are positioned on edge with their side faces normal to the upper face of the protective armor panel (not shown). The first set of the metal strips (22, 24, 26 and 28 in the illustrated embodiment) are arranged on edge and parallel to one another with their side faces generally normal to the upper face of the protective armor panel 10 while the second set of metal strips (30, 32, 34 and 36 in the illustrated embodiment) are also arranged on edge and parallel to one another interlocked with and transverse to the first set of the metal strips (22, 24, 26 and 28 in the illustrated embodiment) in order to form the metal grid 14. Alternatively, the first set of metal strips may be oriented at various angles relative to the second set of metal strips. Furthermore, in some embodiments, the strips within a set of metal strips may not all be parallel to one another.

Figure 5:
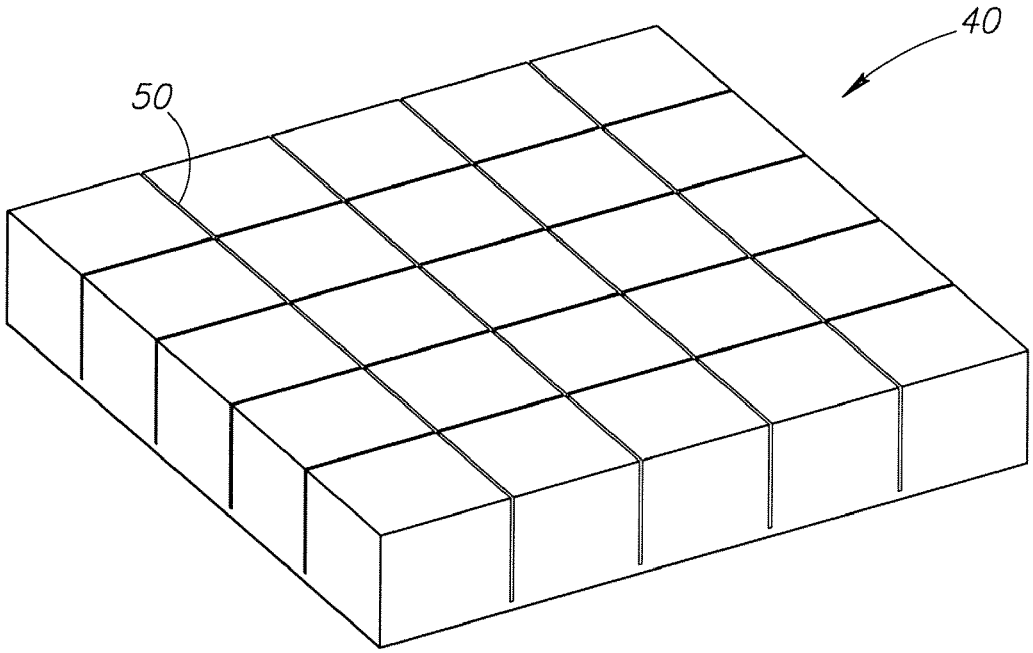
FIG. 5 is an isometric view of an alternate embodiment of a polymer layer for uses in a protective armor panel in which the polymer layer contains grooves for insertion of a metal grid, in accordance with the present invention.

Referring now to FIG. 5, an embodiment of the polymer layer 40 containing grooves 50 for insertion of the metal grid 14 (not shown) is shown in isometric view. In this embodiment, the polymer layer 40 is prepared using well-know injection molding techniques and then machined to create grooves 50 for insertion of the metal grid 14. The assembled metal grid 14 is then placed into and secured within the grooves 50 of the polymer layer 40 to form the protective armor panel 10.

Figure 6:
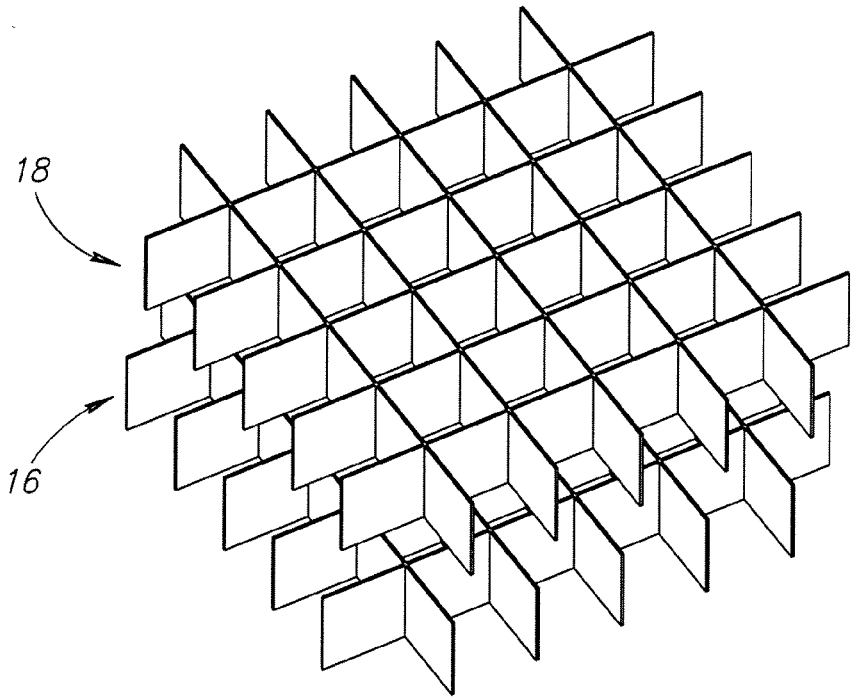
FIG. 6 is an isometric view of a multiple metal grid arrangement for use in a protective armor panel, in accordance with the present invention.

Referring now to FIG. 6, a multiple metal grid arrangement for use in the protective armor panel 10 of the present invention is shown in isometric view. In the illustrated embodiment, a first metal grid 16 and a second metal grid 18 are used. The possible arrangements of metal strips in each of the metal grids is the same as set forth above for the single metal grid 14. The first metal grid 16 and the second metal grid 18 are offset from one another to decrease open spaces in the protective armor panel 10 and thereby increase its protective ability.

Figure 7:
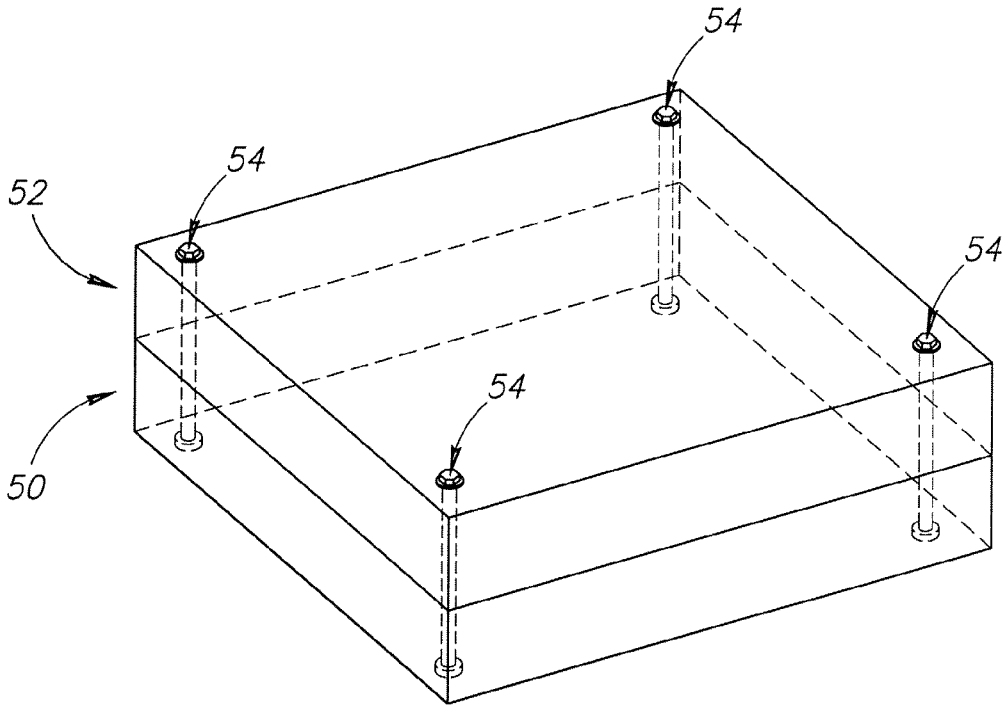
FIG. 7 is an isometric view of a multiple protective armor panel arrangement, in accordance with the present invention.

Referring now to FIG. 7, an embodiment utilizing multiple protective armor panels 10 is shown in isometric view. In the illustrated embodiment, a first protective armor panel 50 and a second protective armor 52 are used and connected using a bolt and nut arrangement 54. A multiple protective armor panel arrangement of this kind provides for more energy absorption and a greater degree of protection. Each of the protective armor panels 10 have the possible characteristics of the single protective armor panel 10 discussed above. However, the protective armor panels 10 in such a multiple grid arrangement do not need to be identical.

It should be understood that the present disclosure is not limited to the embodiments disclosed herein as such embodiments may vary somewhat. It is also to be understood that the terminology employed herein is used for the purpose of describing particular embodiments only and is not intended to be limiting in scope and that limitations are only provided by the appended claims and equivalents thereof.

What is claimed is:

1. A protective armor panel comprising:

a polymer layer having upper and lower faces generally forming a sheet, the upper face defining a plane; and a plurality of metal strips each having an upper edge, a lower edge, and side faces, the edges being substantially narrower than the side faces, the side faces being oriented generally transverse to the plane and positioned at least partially within the polymer layer.

2. The protective armor panel of claim 1 wherein the plurality of metal strips forms a metal grid with first and second sets of strips.

3. The protective armor of claim 2 wherein a first set of the plurality of metal strips interlocks with a second set of the plurality of metal strips to form the metal grid, the first set of strips extends generally in a first direction and the second set of strips extends generally in a second direction transverse to the first direction, at least some of first set of strips having slots therein for receiving at least some of the second set of strips.

4. The protective armor of claim 3 wherein the plurality of metal strips within each set of metal strips are parallel to one another.

5. The protective armor of claim 4 wherein the side faces of the plurality of metal strips within each set of metal strips are normal to the upper face of the protective armor panel.

6. The protective armor panel of claim 2 wherein the metal grid is capable of fragmenting an incoming projectile and the thermoplastic polymer layer is capable of absorbing and disbursing the energy of the projectile fragments.

7. The protective armor panel of claim 3 wherein the metal grid is made from a metal selected from the group consisting an aluminum alloy, titanium and stainless steel.

8. The protective armor panel of claim 7 wherein the metal grid is stainless steel.

9. The protective armor panel of claim 1 wherein the polymer layer is a thermoplastic polymer selected from the group consisting of polycarbonate.

10. The protective armor panel of claim 9 wherein the thermoplastic polymer is polycarbonate.

11. The protective armor panel of claim 1 wherein the metal strips range from about ¼ inch to about ¾ inch in width and from about 0.035 inch to about 0.090 inch in thickness.

12. The protective armor panel of claim 4 wherein the spacing between parallel metal strips in the first set of the plurality of metal strips and the second set of the plurality of metal strips ranges from about ⅛ inch to about ½ inch.

13. The protective armor panel of claim 1 having a thickness of about 0.25 inch to about 1.5 inch.

14. The protective armor panel of claim 13 having a thickness of about 0.25 inch to about 0.75 inch.

15. The protective armor panel of claim 2 further comprising one or more additional metal grids.

16. The protective armor panel of claim 15 wherein the metal grids are offset from one another.

17. The protective armor panel of claim 15 comprising one additional metal grid.

18. The protective armor panel of claim 2 wherein the polymer layer contains grooves in which the metal grid is placed and secured.

19. A protective armor panel comprising:

first and second faces generally forming a sheet; and a grid including a plurality of flat strips each having a first edge, a second edge opposite the first edge, and first and second side faces between the edges, the edges being substantially narrower than the side faces, wherein a first set of the plurality of strips are arranged generally side-by-side, on edge, and extending in generally the same direction as one another with their side faces substantially transverse to the first face of the protective armor panel; and a second set of the plurality of strips are arranged generally side-by-side, on edge, and extending in generally the same direction as one another and substantially transverse to the first set of strips with their side faces substantially transverse to the first face of the protective armor.

20. The protective armor panel of claim 19, wherein the first set of strips are formed of stainless steel.

21. The protective armor panel of claim 19, further comprising a polymer layer at the first face of the sheet, wherein the polymer layer includes a polycarbonate material.

22. The protective armor panel of claim 21, wherein the grid is positioned at least partially within the polymer layer.

23. The protective armor panel of claim 19 comprising at least one additional grid positioned adjacent the first grid.

24. The protective armor panel of claim 23, wherein the additional grid is offset from the first grid, the additional grid having substantially flat strips on edge that are not aligned directly with the first grid.

25. The protective armor panel of claim 21, further comprising a second polymer layer positioned at the second face of the sheet.

26. The protective armor panel of claim 25, wherein the first and second polymer layers are formed in a single molded piece substantially encasing the grid.

27. The protective armor panel of claim 19, wherein the first and second sets of strips are interlocked one with another.

* * * * *